US007993250B2

(12) United States Patent
Abbott

(10) Patent No.: US 7,993,250 B2
(45) Date of Patent: Aug. 9, 2011

(54) EXERCISE APPARATUS AND METHOD OF USE

(76) Inventor: Jerry Abbott, Las Vegas, NV (US)

( * ) Notice: Subject to any disclaimer, the term of this patent is extended or adjusted under 35 U.S.C. 154(b) by 0 days.

(21) Appl. No.: 12/892,829

(22) Filed: Sep. 28, 2010

(65) Prior Publication Data

US 2011/0077135 A1 Mar. 31, 2011

Related U.S. Application Data

(60) Provisional application No. 61/246,412, filed on Sep. 28, 2009.

(51) Int. Cl.
*A63B 21/06* (2006.01)

(52) U.S. Cl. ..... 482/93; 482/126; 482/142

(58) Field of Classification Search ..... 482/34, 482/82, 91, 110, 120, 121, 122, 123, 126, 482/130, 132, 139, 140, 142, 148, 907, 93; 446/220, 236, 240, 396; 472/135; 473/575, 473/576, 596, 609, 610; 601/58, 118, 120, 601/131

See application file for complete search history.

(56) References Cited

U.S. PATENT DOCUMENTS

| | | | | | |
|---|---|---|---|---|---|
| 1,782,254 | A | | 11/1930 | Breidenbach | |
| 3,403,906 | A | * | 10/1968 | Burzenski | 482/132 |
| 3,589,721 | A | * | 6/1971 | Cronauer | 482/125 |
| 4,136,867 | A | * | 1/1979 | Wilkin | 482/132 |
| 5,499,961 | A | * | 3/1996 | Mattox | 482/132 |
| 5,735,776 | A | | 4/1998 | Swezey et al. | |
| 5,810,700 | A | | 9/1998 | Orcutt | |
| 5,833,587 | A | | 11/1998 | Strong et al. | |
| D425,585 | S | * | 5/2000 | Wu | D21/676 |
| 6,174,269 | B1 | * | 1/2001 | Eschenbach | 482/132 |
| 6,203,476 | B1 | * | 3/2001 | Wang et al. | 482/121 |
| D445,852 | S | * | 7/2001 | Mishan et al. | D21/662 |
| 6,375,601 | B1 | | 4/2002 | Johnson | |
| 6,500,105 | B1 | * | 12/2002 | Kuo | 482/123 |
| 6,547,703 | B1 | | 4/2003 | Swezey et al. | |
| 6,689,026 | B2 | | 2/2004 | Almada | |
| 6,746,372 | B2 | | 6/2004 | Hsu | |
| 6,837,835 | B2 | * | 1/2005 | Huang | 482/126 |
| 6,837,836 | B2 | | 1/2005 | Huang | |
| D503,756 | S | | 4/2005 | Chiang | |
| D521,084 | S | * | 5/2006 | Huang | D21/662 |
| 7,060,015 | B2 | | 6/2006 | Acher | |
| D552,696 | S | | 10/2007 | Hallar | |
| 7,285,080 | B1 | | 10/2007 | Chiu | |
| 7,344,487 | B2 | | 3/2008 | Carter et al. | |

(Continued)

OTHER PUBLICATIONS

Merriam Webster's Dictionary, 10th Edition, 1997. pp. 225 & 1156.*

*Primary Examiner* — Loan Thanh
*Assistant Examiner* — Tam Nguyen
(74) *Attorney, Agent, or Firm* — Greenberg Traurig

(57) ABSTRACT

An exercise ball with handles facilitates an abdominal, chest and arm workout. The exercise ball is a pliable material inflated and having a pair of handles oppositely positioned on a support rod extending through the exercise ball. The exercise ball rotates relative to the handles. An incline or ramp is used with the exercise ball to create added resistance thereby increasing the effectiveness of the muscle workout. Resistance bands attach to the handles of the exercise ball on one end and a user's feet on the other end to provide added resistance.

4 Claims, 13 Drawing Sheets

U.S. PATENT DOCUMENTS

| | | | | |
|---|---|---|---|---|
| 7,674,216 | B1 | 3/2010 | Bolling | |
| 2001/0001094 | A1* | 5/2001 | Panes | 482/93 |
| 2003/0195098 | A1* | 10/2003 | Hsu | 482/148 |
| 2004/0110611 | A1 | 6/2004 | Huang | |
| 2006/0040808 | A1 | 2/2006 | Riazi | |
| 2007/0066461 | A1 | 3/2007 | Carter et al. | |
| 2007/0117682 | A1 | 5/2007 | Deola | |
| 2009/0325770 | A1 | 12/2009 | Baschnagel | |

* cited by examiner

FIG. 1a
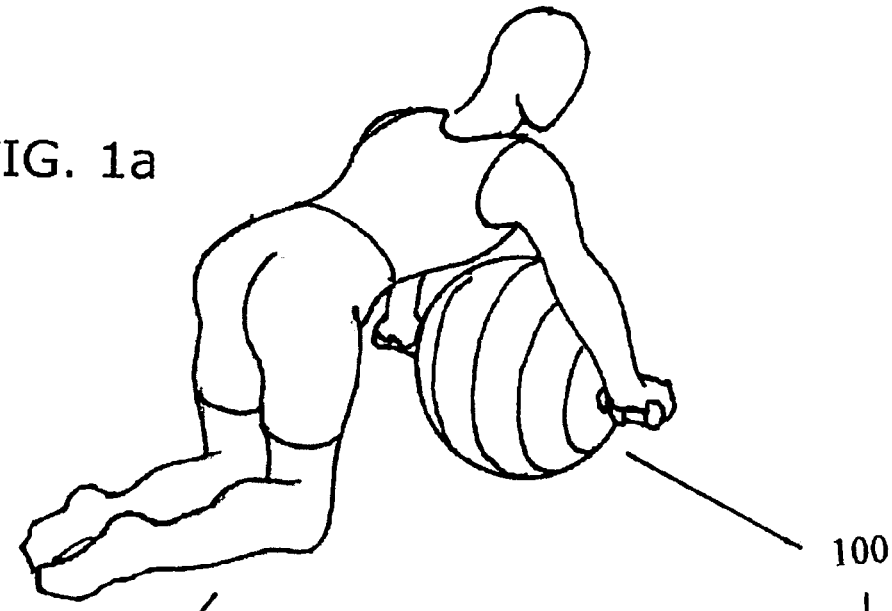
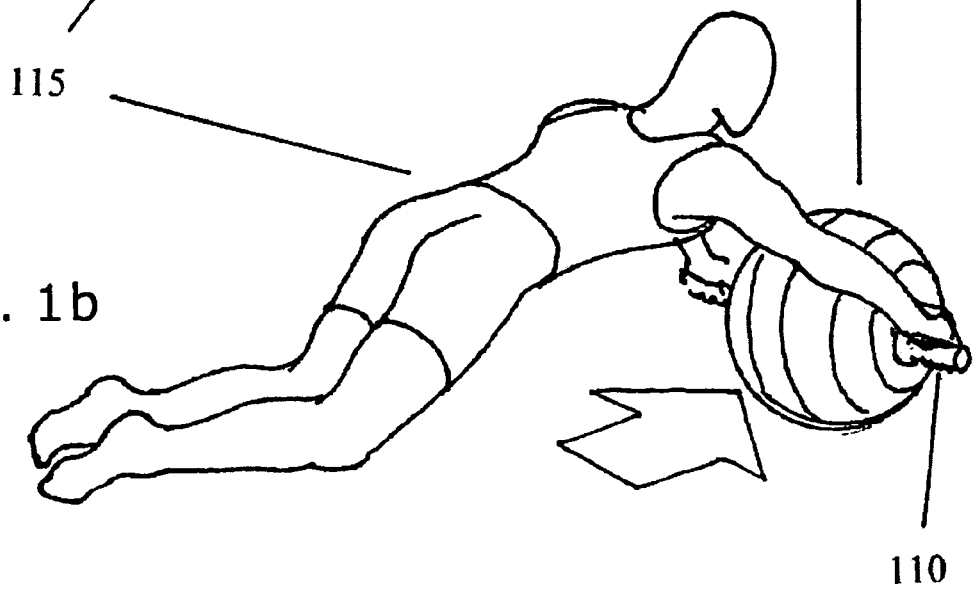
FIG. 1b

EXERCISE APPARATUS AND METHOD OF USE

CROSS-REFERENCE TO RELATED APPLICATION

This application claims the benefit of U.S. Provisional Patent Application No. 61/246,412 filed on Sep. 28, 2009.

FIELD OF THE INVENTION

The embodiments of the present invention relate to an exercise apparatus comprising an exercise ball with handles, and/or incline or ramp, and/or resistance bands which when used in combination work at least the abdominal, chest and arm muscles.

BACKGROUND

Exercise is the cornerstone of health. Consequently, exercise devices are ubiquitous in the marketplace. Such exercise devices can be directed to the cardiovascular system or specific muscle groups or both. A primary target muscle group is the abdominals since people take pride in having flat stomachs (i.e., six packs). Despite the number of exercise devices in the marketplace, there are drawbacks including exercise difficulty, poor quality, lack of effectiveness, expense, size, etc.

Thus, there is a need for an exercise system that reduces or eliminates the aforementioned drawbacks while providing an effective workout.

SUMMARY

Accordingly, in one embodiment of the present invention an exercise ball with handles facilitates an abdominal, chest and arm workout. In one embodiment, the exercise ball is a pliable material inflated and having a pair of handles oppositely positioned on a support rod extending through the exercise ball. The exercise ball rotates relative to the handles. In another embodiment, an incline or ramp is used with the exercise ball to create added resistance thereby increasing the effectiveness of the muscle workout. In yet another embodiment, resistance bands attach to the handles of the exercise ball on one end and a user's feet on the other end to provide added resistance.

The exercise ball described herein allows a user to rest on his or her knees while holding the handles extending from the exercise ball to repeatedly lunge or push forward and pull back. The exercise targets the abdominal, arm and chest muscles while increasing cardiovascular activity. The ramp or incline supports the exercise ball such that the user lunges or pushes the exercise ball up the ramp against resistance caused by gravity. The resistance bands may be used with the exercise ball and with or without the ramp to further increase resistance.

Other variations, embodiments and features of the present invention will become evident from the following detailed description, drawings and claims.

BRIEF DESCRIPTION OF THE DRAWINGS

FIGS. 1*a* and 1*b* illustrate a perspective view of an exercise ball with handles being demonstrated according to a first embodiment of the present invention;

DETAILED DESCRIPTION

Figure 2:
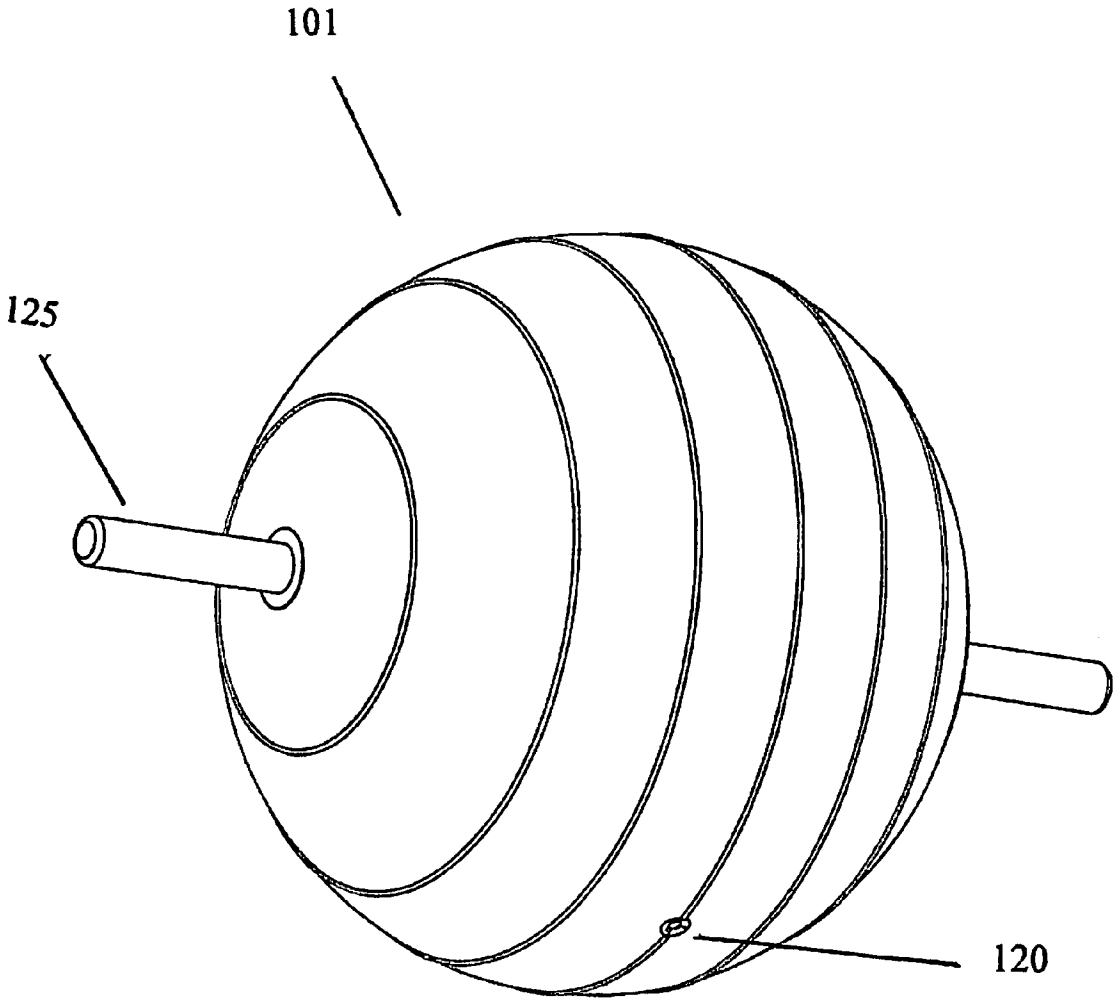
FIG. 2 illustrates a perspective view of an exercise ball according to a first embodiment of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The embodiments of the present invention include an exercise ball with handles, and/or incline or ramp, and/or resistance bands attached to the handles of the exercise ball. Those skilled in the art will recognize that the exercise ball described herein may be used independent of the incline or ramp and/or resistance bands.

FIGS. 1*a* and 1*b* show perspective views of an exercise ball 100, of the type described below, including handles 110 being demonstrated by a user 115. In FIG. 1*a*, the user 115, in a kneeling initial position, grasps the handles 110 and next, as shown in FIG. 1*b*, lunges or pushes the exercise ball 100 forward thereby extending and working the abdominal, arm and chest muscles. The user then pulls the exercise ball 100 back to the initial position and repeats the forward and backward exercise procedure during a workout session. Importantly, the exercise ball 100 and handles 110 are configured to allow the exercise ball 100 to rotate relative to the handles 110 or at least outer members thereof.

Figure 3:
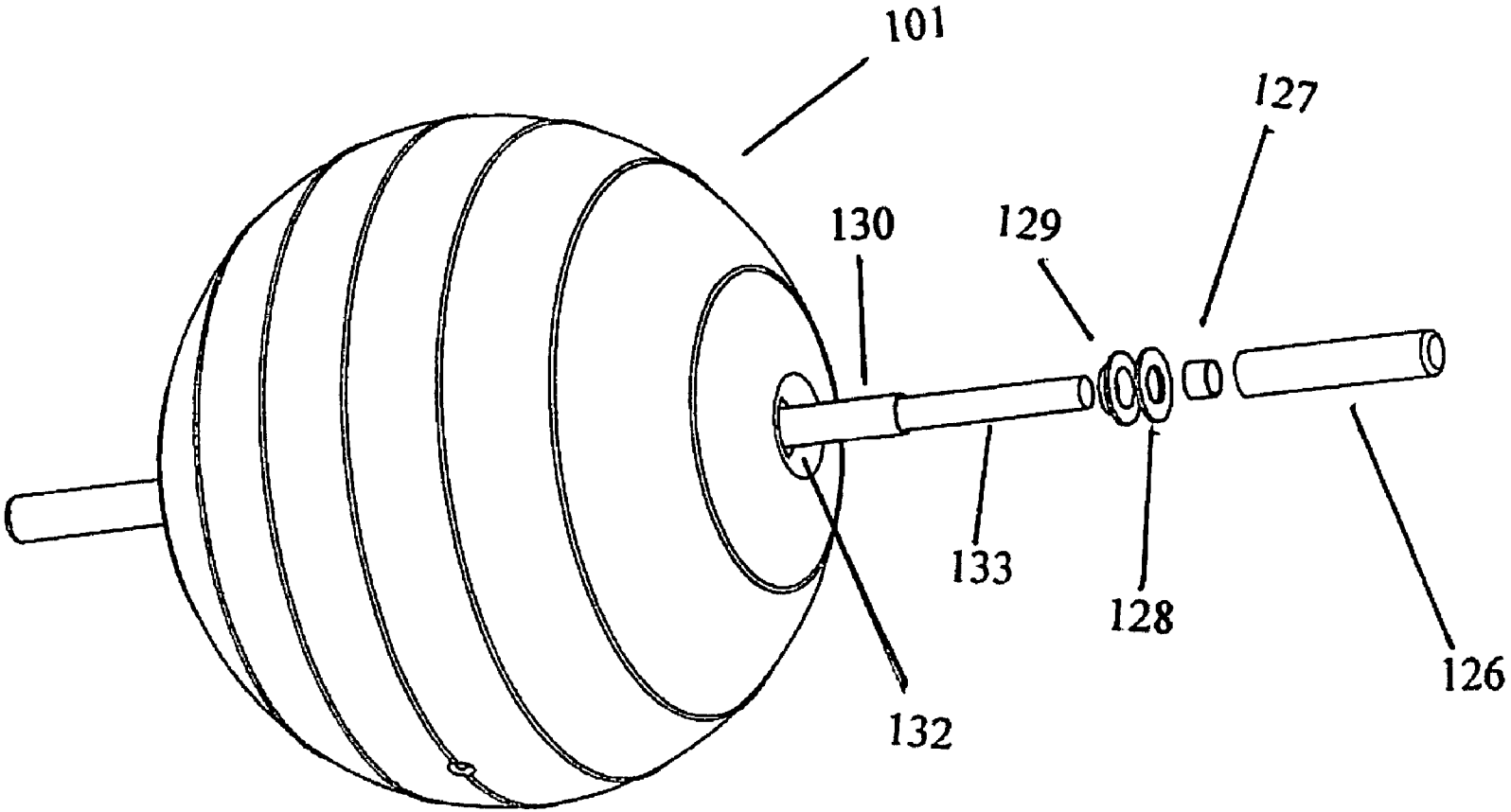
FIG. 3 illustrates a perspective view of an exercise ball with an exploded handle according to a first embodiment of the present invention.
Figure 4:
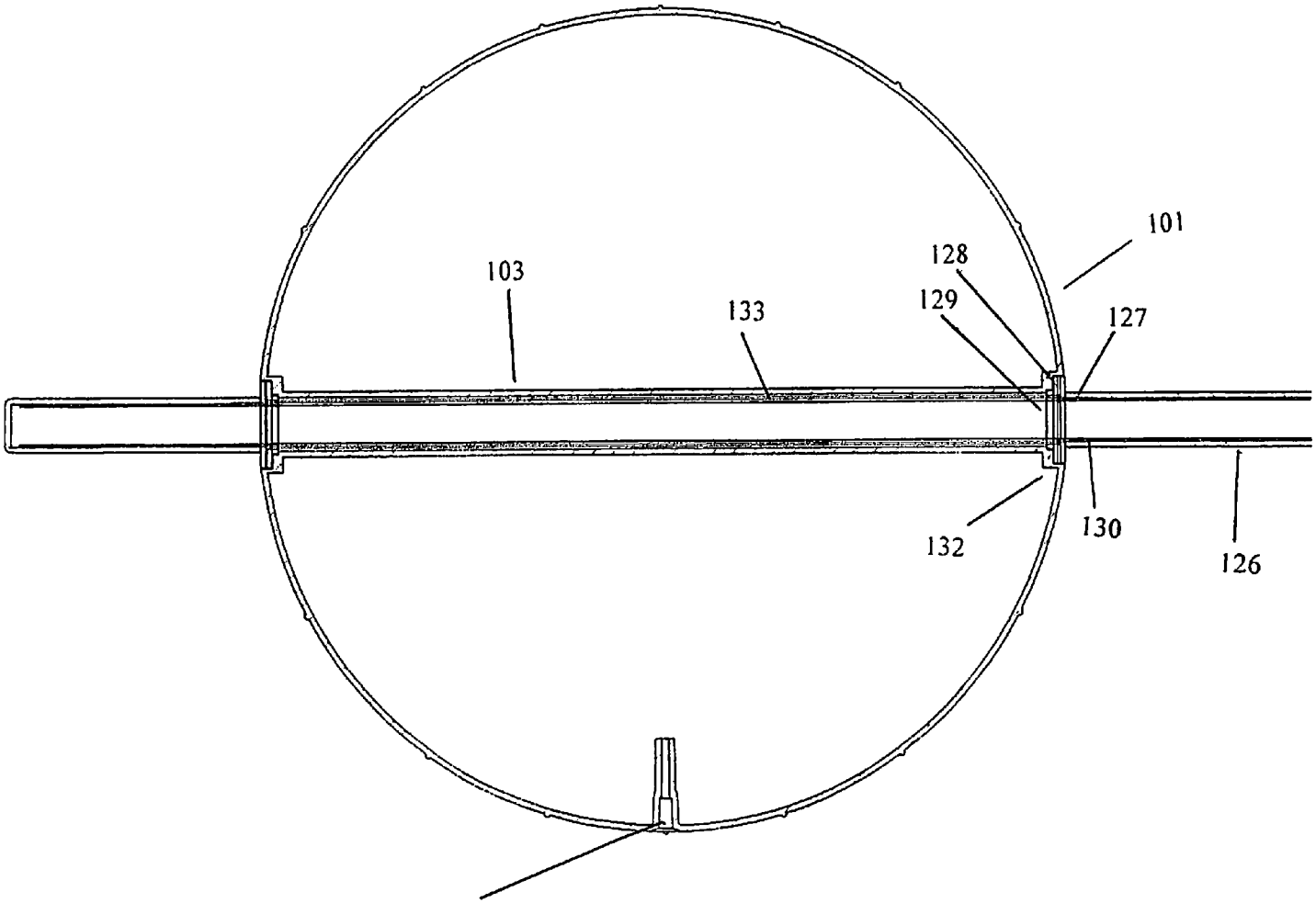
FIG. 4 illustrates a cross-sectional side view of an exercise ball and handle according to a first embodiment of the present invention.

FIGS. 2-4 show an exercise ball 101 according to the embodiments of the present invention. The exercise ball 101 is an inflatable type ball having an opening 120 with insert 121 for receiving a pump needle for inflating the exercise ball 101. In this embodiment, the handles 125 comprise an outer handle grip 126, plug 127, washer 128 and washer with lip 129. The washer with lip 129 slips over collar 130 and sits within handle cavity 132. Washer 128 slips over collar 130 and butts up against the washer with lip 129. Plug 127 maintains handle grip 126 rotatably in position over collar 130. Support rod 133 extends through exercise ball 101 and into collar 130 thereby supporting handles 125. In this manner, the exercise ball 101 is able to rotate freely about said support rod 133.

Figure 5:
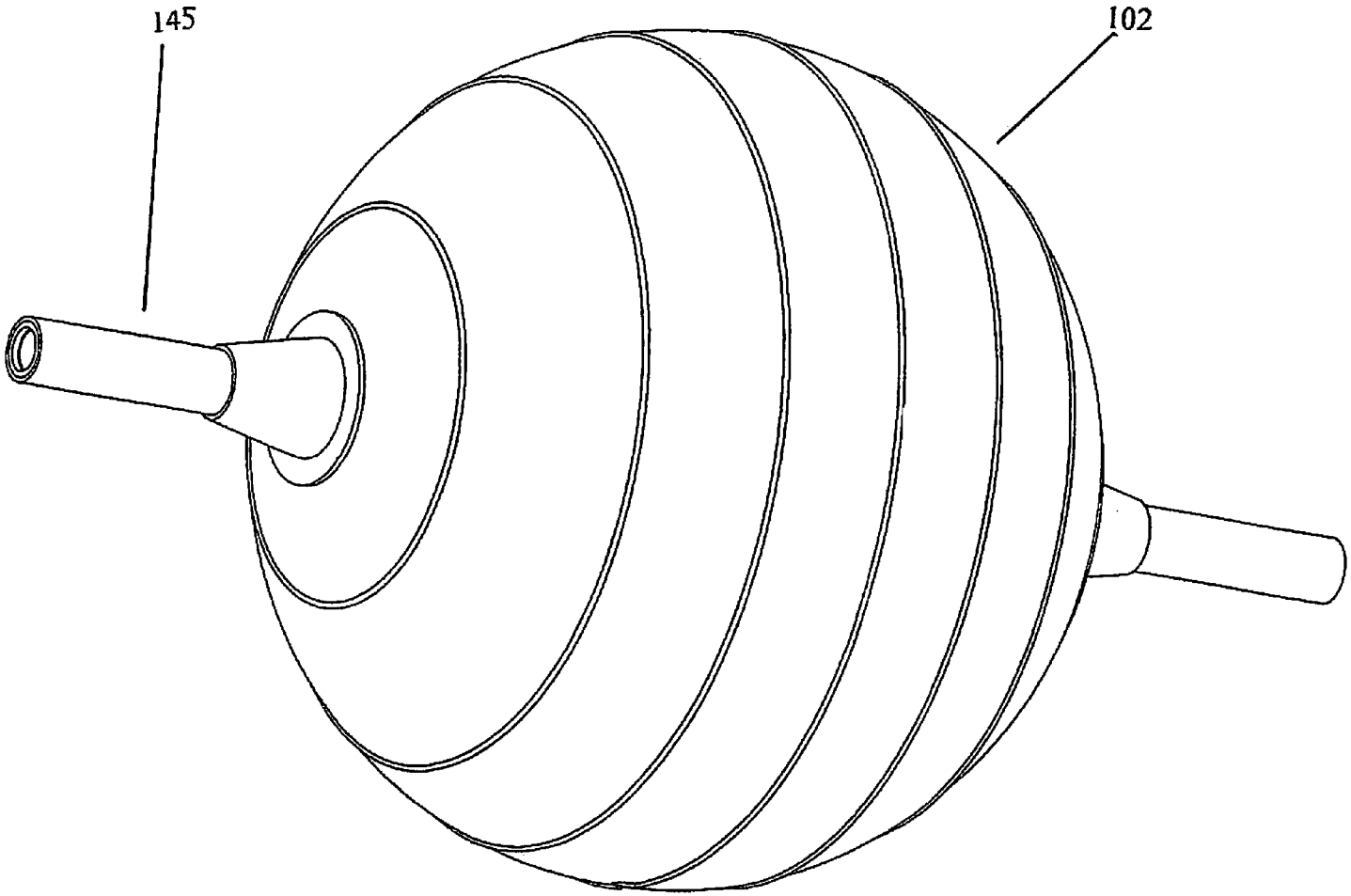
FIG. 5 illustrates a perspective view of an exercise ball with handles according to a second embodiment of the present invention.
Figure 6:
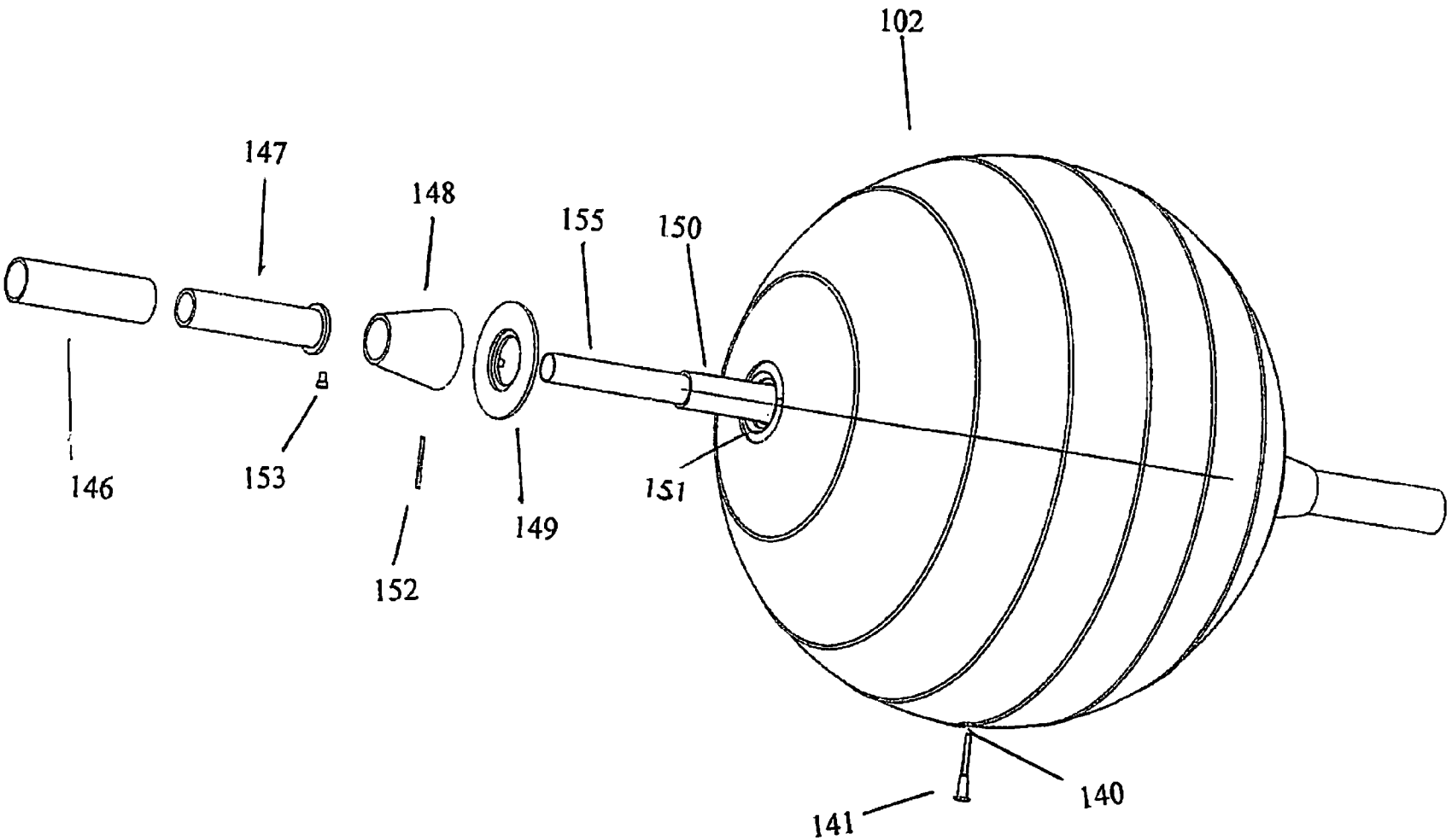
FIG. 6 illustrates a perspective view of an exercise ball with an exploded handle according to a second embodiment of the present invention.
Figure 7:
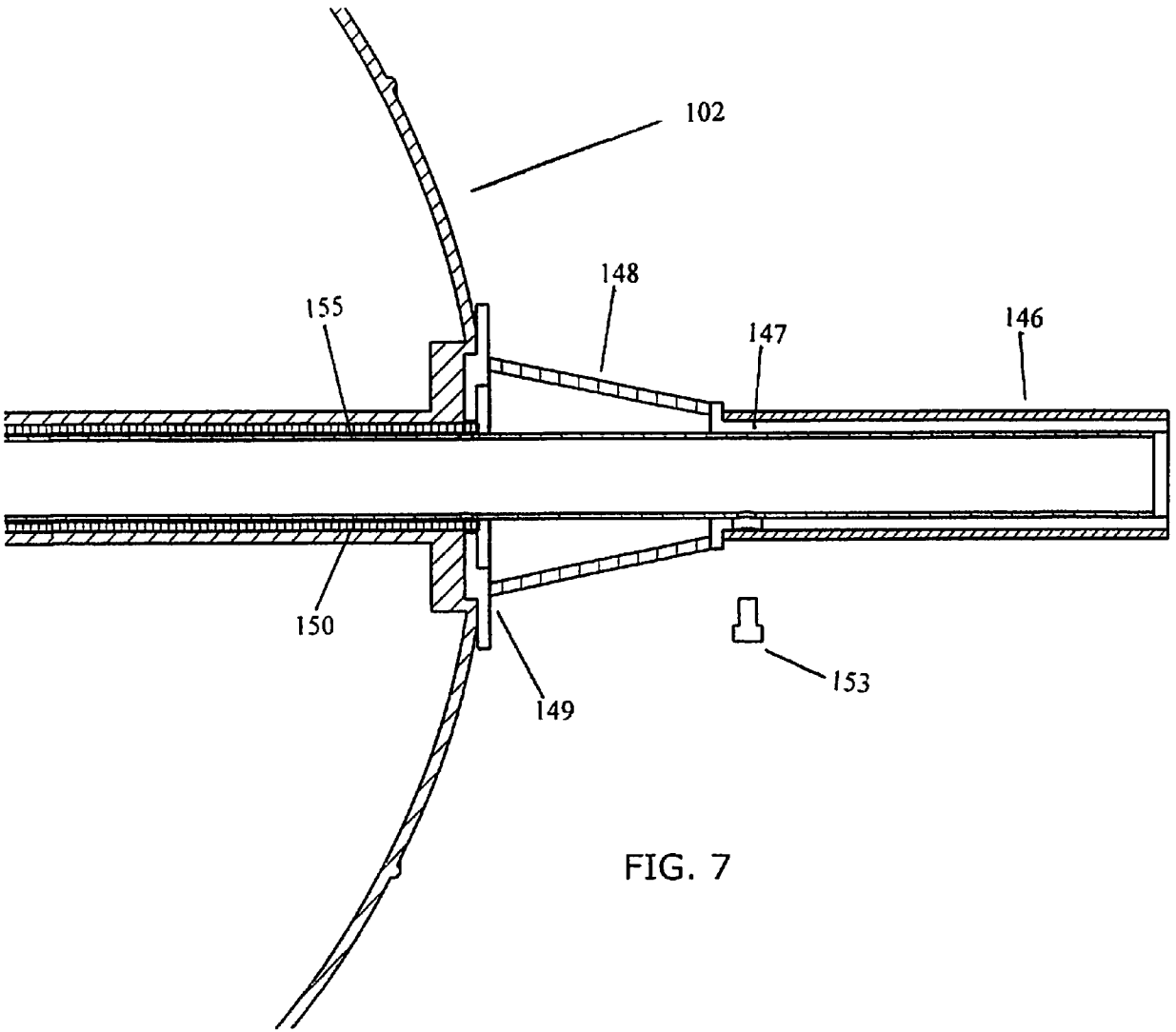
FIG. 7 illustrates a cross-sectional view of an exercise ball and handle according to a second embodiment of the present invention.

FIGS. 5-7 show an exercise ball 102 according to the embodiments of the present invention. The exercise ball 102 is an inflatable type ball having an opening 140 with insert 141 for receiving a pump needle for inflating the same. In this embodiment, the handles 145 comprise an outer handle grip 146, inner handle support 147, tapered collar 148 and washer with lip 149. The washer with lip 149 slips over collar 150 and sits within handle cavity 151. Tapered collar 148 slips over collar 150 and into the washer with lip 149. Pin 152 and bushing 153 maintain inner handle support 147 in place on the collar 150. Support rod 155 extends through exercise ball 102 and into collar 150 thereby supporting handles 145. In this manner, the exercise ball 102 is able to rotate freely about said support rod 155.

In both embodiments, the exercise ball 101, 102 is able to rotate relative to the handle grips 126 and 146, respectively. Thus, when the user is able to maintain his or her hands on top of the handles while the exercise ball 101, 102 rolls independently thereof during the performance of exercises as described above and shown in FIGS. 1*a* and 1*b*. In another embodiment, the handles 125 and 145 may be removed from the exercise ball 101, 102.

Figure 8:
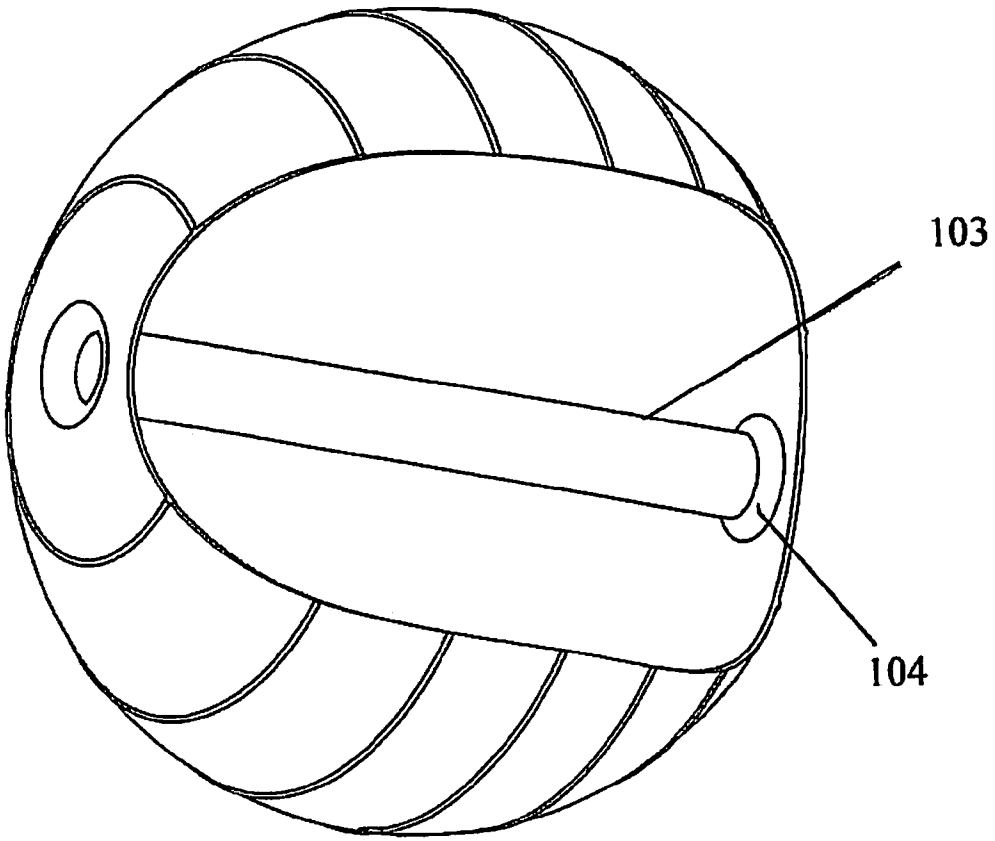
FIG. 8 illustrates a perspective cut-away view of an exercise ball according to the embodiments of the present invention.

FIG. 8 shows a cut-away of the exercise ball 100, 101 and 102 with an inner channel 103 exposed. The inner channel 103 extends from one side of the exercise ball to an opposite side of the exercise ball. The support rods 133, 155 extend through the inner channel 103 and into collars 130, 150. The support rods 133, 155 are free to rotate within the channel 103. The channel 103 is sealed to the inner surface 104 of the exercise ball 100, 101 and 102 to allow the exercise ball 100, 101 and 102 to remain inflated.

Figure 9:
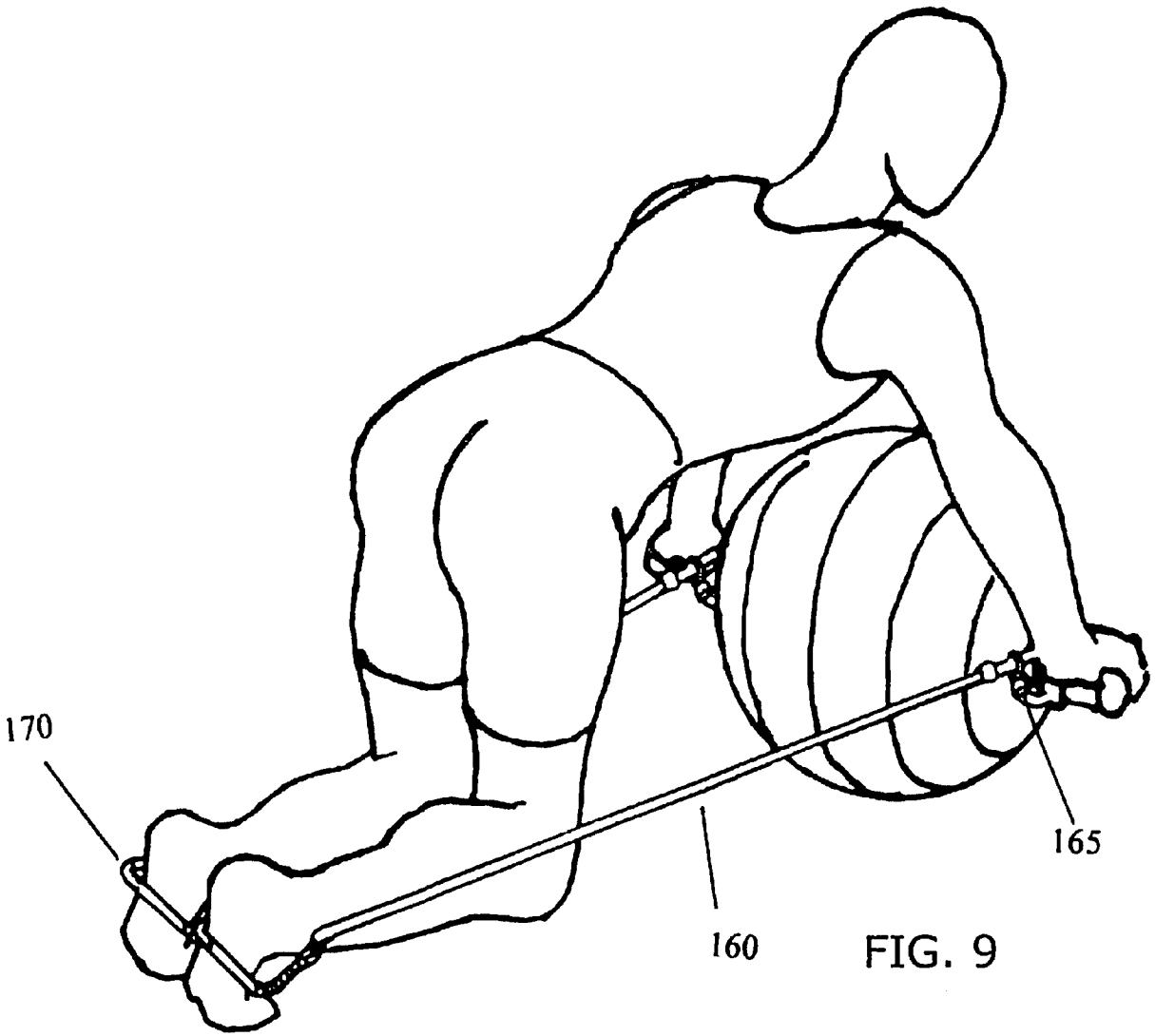
FIG. 9 illustrates a perspective view of an exercise ball and resistance bands being demonstrated according to the embodiments of the present invention being demonstrated.
Figure 10:
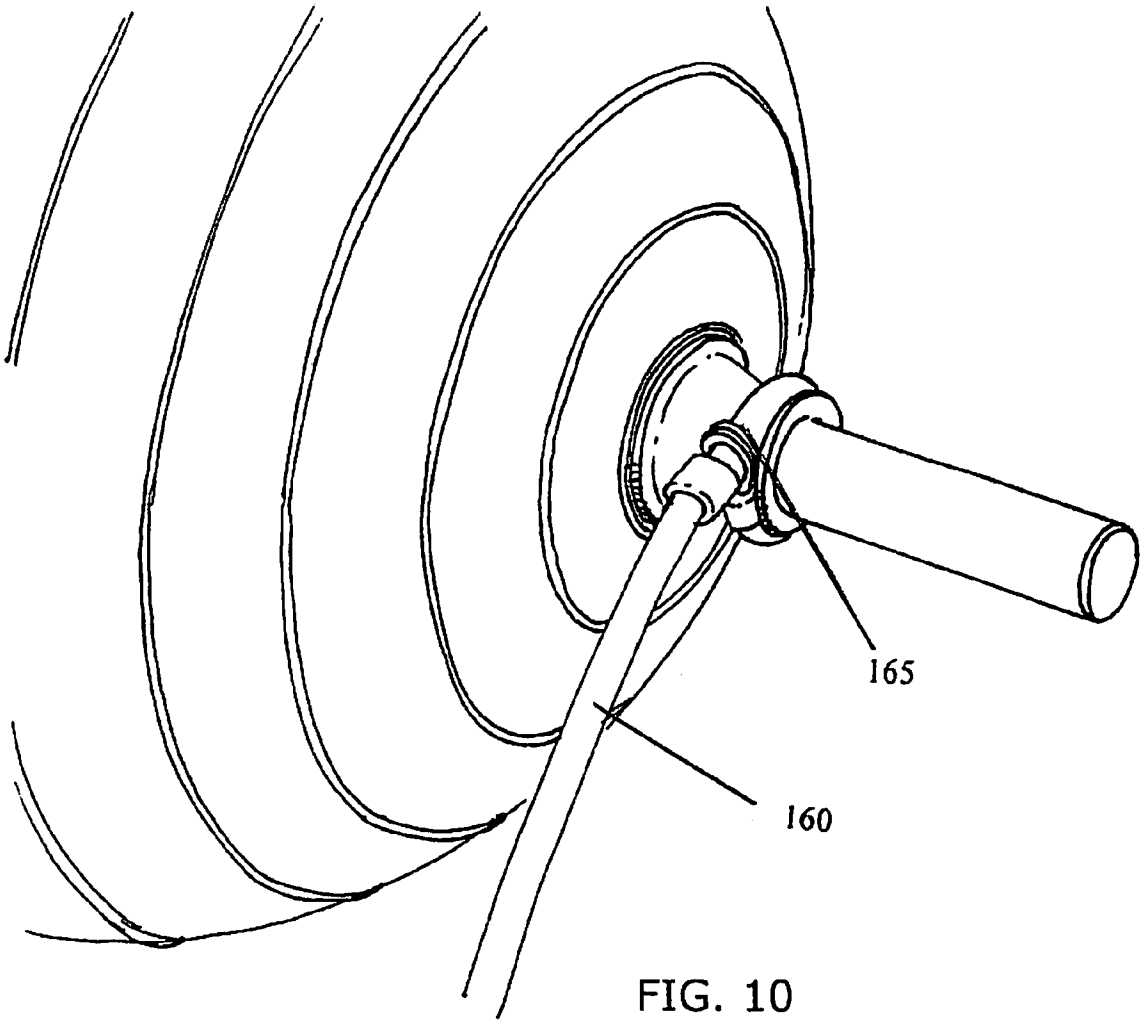
FIG. 10 illustrates a perspective view of a resistance band attached to a handle of an exercise ball according to the embodiments of the present invention.
Figure 11:
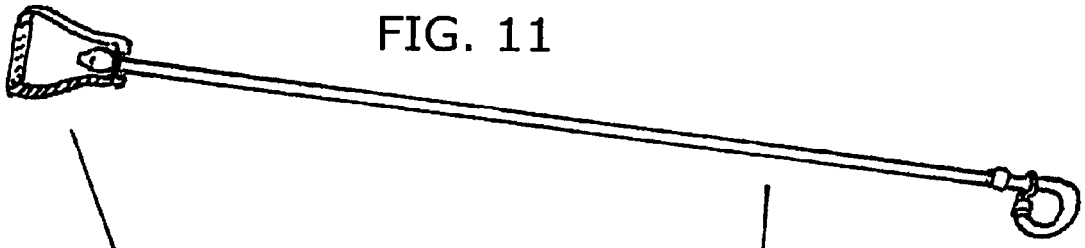
FIG. 11 illustrates a perspective view of an resistance band according to the embodiments of the present invention.
Figure 13:
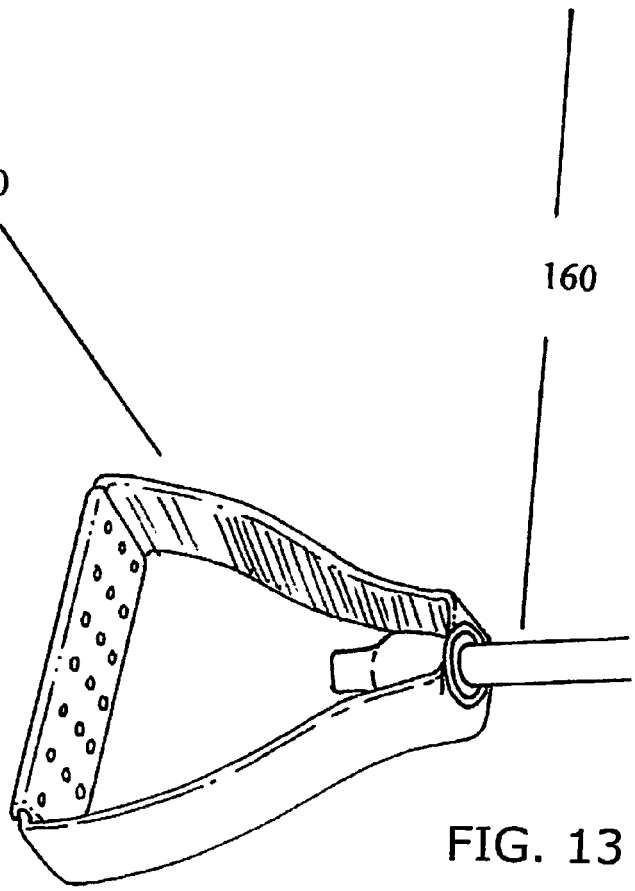
FIG. 13 illustrates a perspective view of a stirrup associated with a resistance band according to the embodiments of the present invention.
Figure 12:
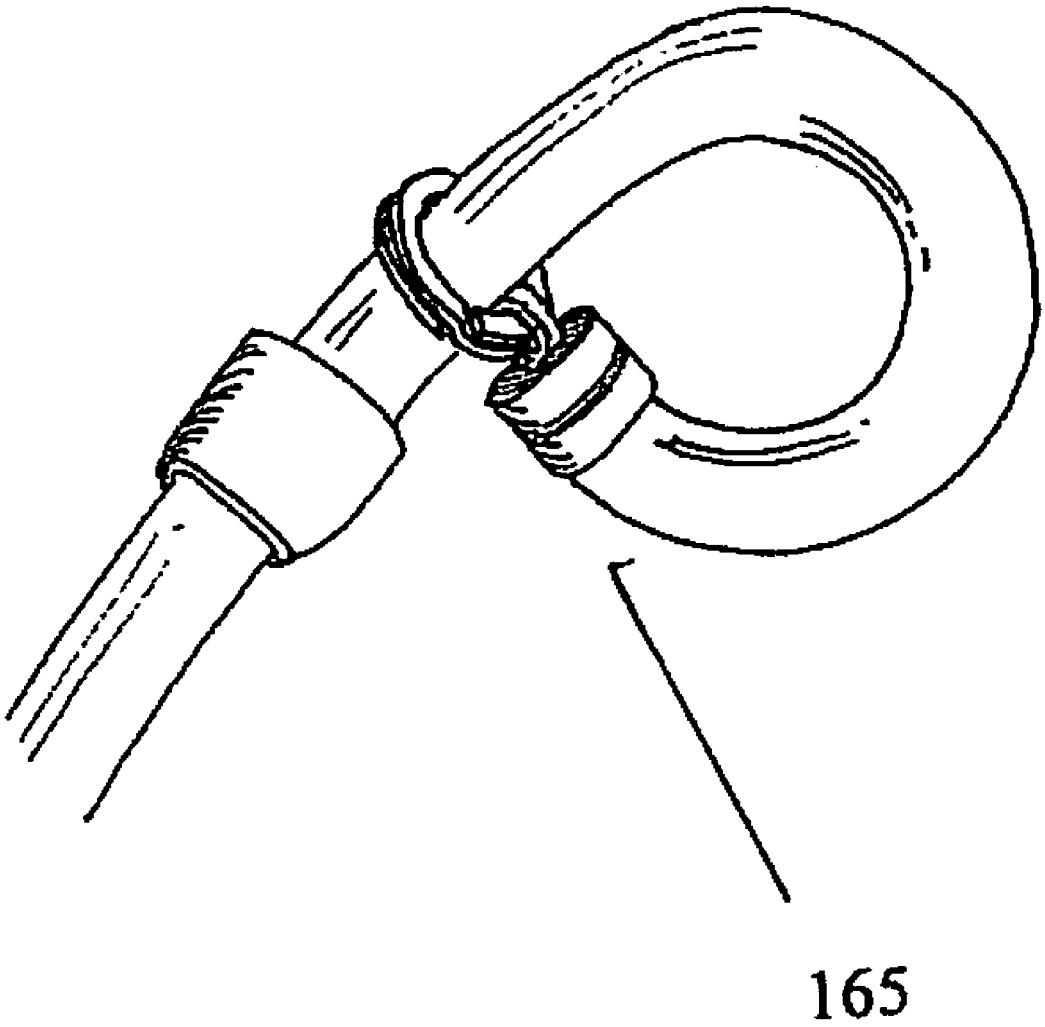
FIG. 12 illustrates a perspective view of an attachment means associated with a resistance band according to the embodiments of the present invention.

In another embodiment, as shown in FIGS. 10-13, resistance bands 160 are used in combination with an exercise ball 100, 101 and 103 to increase resistance. The resistance bands 160 hook to the handles 110, 125 and 145 via adjustable loops 165. Opposite the adjustable loops 165 are stirrups 170 each configured to retain a user's foot. FIG. 9 shows the resistance bands 160 and exercise ball being demonstrated. The resistance bands 160 provide additional resistance as the exercise ball is lunged or pushed forward.

Figure 14:
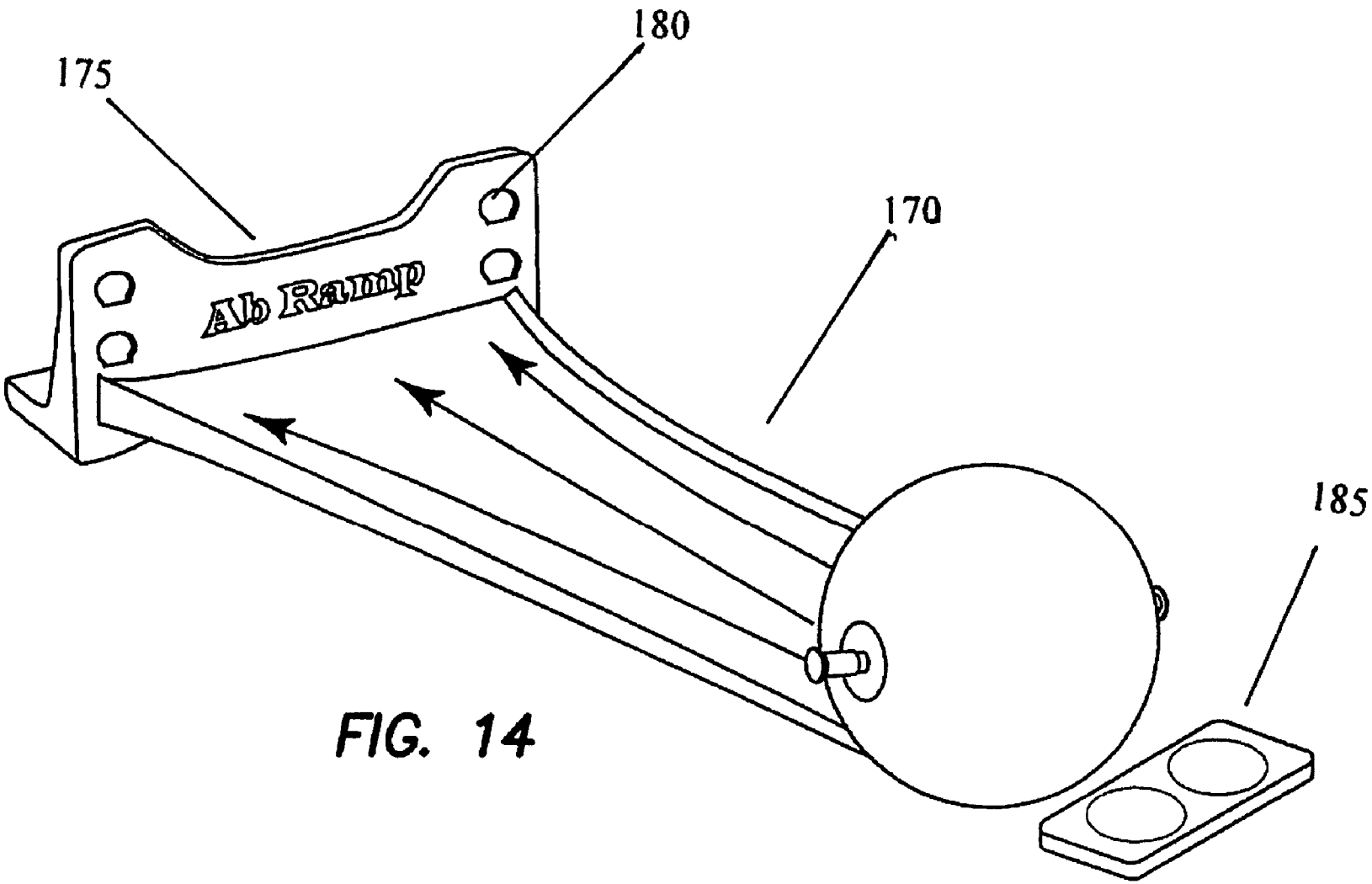
FIG. 14 illustrates a perspective view of a ramp according to the embodiments of the present invention.

FIG. 14 shows a ramp 170 or incline which can be used with the exercise ball 100, 101 and 102 to increase resistance as a function of overcoming gravity. The ramp 170 includes means for adjusting the angle of the ramp 170 to further adjust resistance. As shown, the means for adjusting the angle comprises a support member 175 having openings 180 for receiving pegs (not shown) extending from one end of said ramp 170. A knee pad or cushion 185 may be used during exercises.

The exercise ball described herein may be fabricated of any inflatable material such as polymers, rubber, plastics and the like.

Although the invention has been described in detail with reference to several embodiments, additional variations and modifications exist within the scope and spirit of the invention as described and defined in the following claims.

I claim:

1. An exercise apparatus comprising:

an inflatable ball having a channel extending through said ball, and a pair of handle cavities, one of said handle cavities is located at each opposing end of said channel and on opposite sides of said ball;

a support rod extending through said channel and said handle cavities such that opposite ends of said support rod protrude from said handle cavities, and said opposite ends of said support rod are each covered by a respective elongated collar; and a pair of handles, each of said handles comprising an outer handle grip, a plug, a washer and a washer having a lip such that each handle is inserted over and supported by a respective opposite end of the support rod wherein the washer having a lip slips over a respective elongated collar and sits within a respective handle cavity, the washer slips over the elongated collar and butts up against the washer having a lip, the plug maintains the outer handle grip in position over the elongated collar and the inflatable ball is rotatable relative to the handles.

2. The exercise apparatus of claim 1 further comprising an adjustable ramp configured to support said inflatable ball during an exercise procedure.

3. An exercise apparatus comprising:

an inflatable ball having a channel extending through said ball, and a pair of handle cavities, one of said handle cavities is located at each opposing end of the channel and on opposite sides of the ball;

a support rod extending through said channel and said handle cavities such that opposite ends of said support rod protrude from said handle cavities, and said opposite ends of said support rod are each covered by a respective elongated collar;

a pair of handles, each of said handles comprising an outer handle grip, an inner handle support, an elongated tapered collar and a washer having a lip such that each handle is inserted over and supported by a respective opposite end of the support rod wherein the washer having a lip slips over a respective elongated collar and sits within a respective handle cavity, the tapered collar slips over the elongated collar and into the washer having a lip, a pin and bushing maintains the inner handle support in place on the elongated collar, the outer handgrip is disposed around the inner handle support and the inflatable ball is rotatable relative to the handles; and a pair of resistance bands, each of said bands configured at one end for attachment to said handles, and each of said bands further having stirrups at a second opposite end of each band wherein the stirrups maintain the feet of a user during an exercise procedure using said inflatable ball.

4. The exercise apparatus of claim 3 further comprising an adjustable ramp configured to support said exercise inflatable ball during an exercise procedure.

* * * * *